US008375616B2

(12) United States Patent
Gomez et al.

(10) Patent No.: US 8,375,616 B2
(45) Date of Patent: Feb. 19, 2013

(54) AUTOMATIC RIFLE BOLT CARRIER WITH FLUTED BOSS

(75) Inventors: Jesus S. Gomez, Cambridge, MD (US); Jason Miller, Rixeyville, VA (US)

(73) Assignee: LWRC International, LLC, Cambridge, MD (US)

( * ) Notice: Subject to any disclaimer, the term of this patent is extended or adjusted under 35 U.S.C. 154(b) by 83 days.

(21) Appl. No.: 12/316,241

(22) Filed: Dec. 10, 2008

(65) Prior Publication Data

US 2012/0137869 A1 Jun. 7, 2012

(51) Int. Cl.
*F41A 3/30* (2006.01)

(52) U.S. Cl. ..... 42/16; 89/191.01

(58) Field of Classification Search ..... 89/24, 191.01; 42/16

See application file for complete search history.

(56) References Cited

U.S. PATENT DOCUMENTS

| | | | | |
|---|---|---|---|---|
| 2,971,441 | A * | 2/1961 | Reed | 89/130 |
| 5,551,179 | A | 9/1996 | Young | |
| 6,418,655 | B1 * | 7/2002 | Kay | 42/75.02 |
| 6,848,351 | B1 * | 2/2005 | Davies | 89/191.01 |
| 7,316,091 | B1 | 1/2008 | Desomma | |
| 7,775,150 | B2 * | 8/2010 | Hochstrate et al. | 89/193 |
| 2005/0011346 | A1 * | 1/2005 | Wolff et al. | 89/12 |
| 2008/0276797 | A1 * | 11/2008 | Leitner-Wise | 89/191.01 |

* cited by examiner

*Primary Examiner* — Stephen M Johnson
(74) *Attorney, Agent, or Firm* — Jacobson Holman PLLC

(57) ABSTRACT

An automatic rifle bolt carrier with a fluted boss for the AR15/M16 family of firearms has been provided. The rear of the bolt carrier has been provided with a boss having bearing surfaces which are in operational contact with the interior of the host firearm's upper receiver to prevent the carrier from tilting while it is reciprocating during normal operation. The boss and rearward end of the bolt carrier are provided with flutes which allow water to flow between the buffer tube and upper receiver while the bolt carrier is reciprocating during normal operation, enabling a properly equipped firearm to be used during over the beach operations. The bolt carrier also includes a scallop cut located about the top of its backmost end which is perpendicular to the longitudinal axis of the bolt carrier.

4 Claims, 8 Drawing Sheets

AUTOMATIC RIFLE BOLT CARRIER WITH FLUTED BOSS

BACKGROUND OF THE INVENTION

1. Field of Invention

This invention relates to automatic rifles. More particularly, the present invention relates to the operating system of firearms in the AR15/M16 series of firearms. Specifically the herein described invention concerns the bolt carrier assembly for use in such firearms.

2. Prior Art

The AR15/M16 family of weapons and their derivatives to include indirect gas operated versions, have been in use by the military and civilian population for many years. An essential part of this firearms design is the bolt carrier which typically includes a bolt mounted in the carrier for axial sliding movement and rotation, a firing pin slidably mounted within the bolt and bolt carrier for restricted reciprocating axial movement, and a cam pin for producing relative rotation between the bolt and the bolt carrier. The bolt carrier is generally cylindrical in shape and is provided with a circular bore throughout its length. The bolt carrier also is provided with an opening on its top and bottom sides to allow the hammer to extend into the interior of the bolt carrier and strike the firing pin. There are also openings to mount a gas key, an opening which serves as a gas receiving port, and an opening to receive the cam pin in direct gas operated firearms. Indirect gas operated firearms, typically referred to as piston operated systems, replace the gas receiving port with a striking surface which varies between iterations. About the exterior of the bolt carrier are a series of usually four (4) lands and usually accompanying grooves which extend from the forward end of the bolt carrier (as it is mounted in the firearm) rearwardly for a distance of about one-half the length of the bolt carrier. A land can be defined as a raised portion on the exterior of the bolt carrier which contacts the interior surface of the upper receiver of the firearm. Such lands are generally equally spaced from one another about the exterior of the bolt carrier and are generally parallel to each other. The exterior surfaces of the lands make contact with the interior surface of the upper receiver of the firearm and serve to align the bolt carrier within the receiver. With the striking surface of indirect gas operated firearm being above the central axis of the bolt carrier a phenomenon known as carrier tilt occurs during the normal operation of the firearm. Carrier tilt can be defined as the rear of the carrier, or boss, tilting down when the striking surface has been contacted by the piston resulting in the rearward movement of the carrier being resisted when the now off axis carrier strikes the shelf of the firearms lower receiver housing. Eliminating carrier tilt would be a very desirable.

Firearms based on the AR15/M16 family are the primary weapon of choice for military units in the United States and abroad. Highly trained units from all branches of service often find themselves operating in aquatic conditions prior to coming on land. The inability of the AR15/M16 series of weapons to be fired when water is present in the operating system puts these war fighters in a compromising position. With the current AR15/M16 series of weapons, and their derivatives, the firearm must be drained of all water prior to being discharged. This is not convenient or practical for a war fighter who may come under fire immediately upon landing on a beach. Such situations are typically referred to as over the beach operations". Incorporating features into the operating system which would allow the firearm to be immediately discharged upon exit from an aquatic environment would be highly desirable.

A bolt carrier which could be utilized with LWRC International's "Firearm with Facility for Open-Bolt and Closed-Bolt Operation" (U.S. Pat. No. 7,806,039) without the use of tools to assemble/disassemble the rifle would be desirable to military and civilian owners who want the benefits offered by such a system.

It would be highly advantageous, therefore, to remedy the foregoing and other deficiencies inherent in the prior art.

OBJECTS AND ADVANTAGES

Accordingly several objects and advantages of the present invention are (a) To provide a bolt carrier which allows the rifle to function safely in over the beach operations.

(b) To provide a bolt carrier with an increased diameter boss thereby preventing carrier tilt and the wear to the host receiver associated therewith.

(c) To provide a carrier which serves as a drop in replacement for a conventional bolt carrier group and allows the firearm to be easily used with the LWRC International's IAR conversion.

Still further objects and advantages will become apparent from a consideration of the ensuing description and drawings.

SUMMARY

Briefly, to achieve the desired objects of the present invention in accordance with a preferred embodiment thereof, provided is firearm from the AR15/M16 family, or an indirect gas operated derivative, having a bolt carrier assembly as previously described, with an improved bolt carrier which can be retrofitted to existing firearms of the AR15/M16 family of firearms without any modification to the receiver of the firearm or any other part thereof. Succinctly stated, the automatic rifle bolt carrier with fluted boss can be distinguished from the prior bolt carrier by a boss which is larger in diameter and in contact with the inside of the receiver, a series of longitudinal flutes about the exterior of the boss, and a scallop cut located on the top of the bolt carrier behind the fluted boss. The rear end of a typical bolt carrier does not contact the inside of the receiver, rather it is supported by the four lands located at the forward end of the device. By increasing the diameter, or boss, at the rear of the carrier there is little or no movement except in the forward or rearward direction of the bolt carrier. This eliminates the carrier from tilting down thereby causing preliminary wear to the receiver and the harmful effects such motion has on accuracy. The addition of flutes about the boss of the bolt carrier allows the weapon to drain water from the internal operating area making over the beech operations possible. The addition of a scallop cut behind the boss allows a weapon equipped with LWRC International's "Firearm with Facility for Open-Bolt and Closed-Bolt Operation" (U.S. Pat. No. 7,806,039) to be assembled without the use of any tools.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
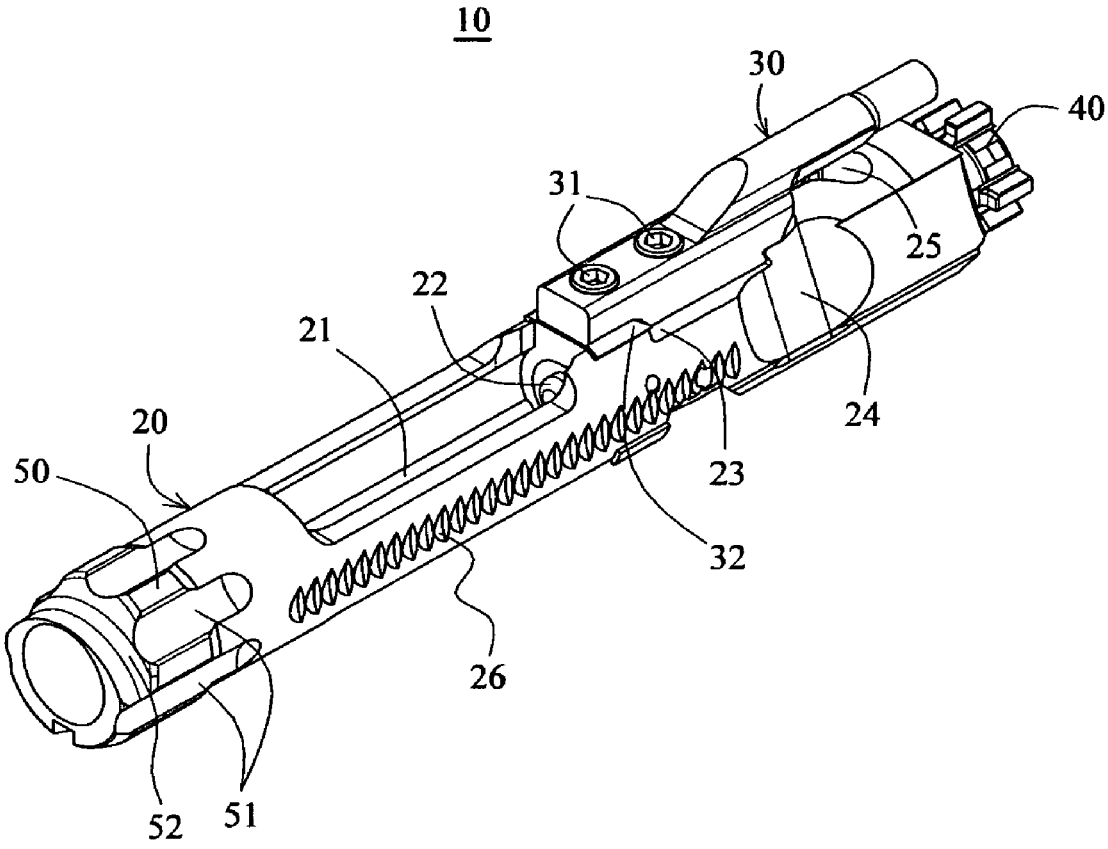
FIG. 1 is a side perspective view of my automatic rifle bolt carrier with fluted boss.
Figure 2:
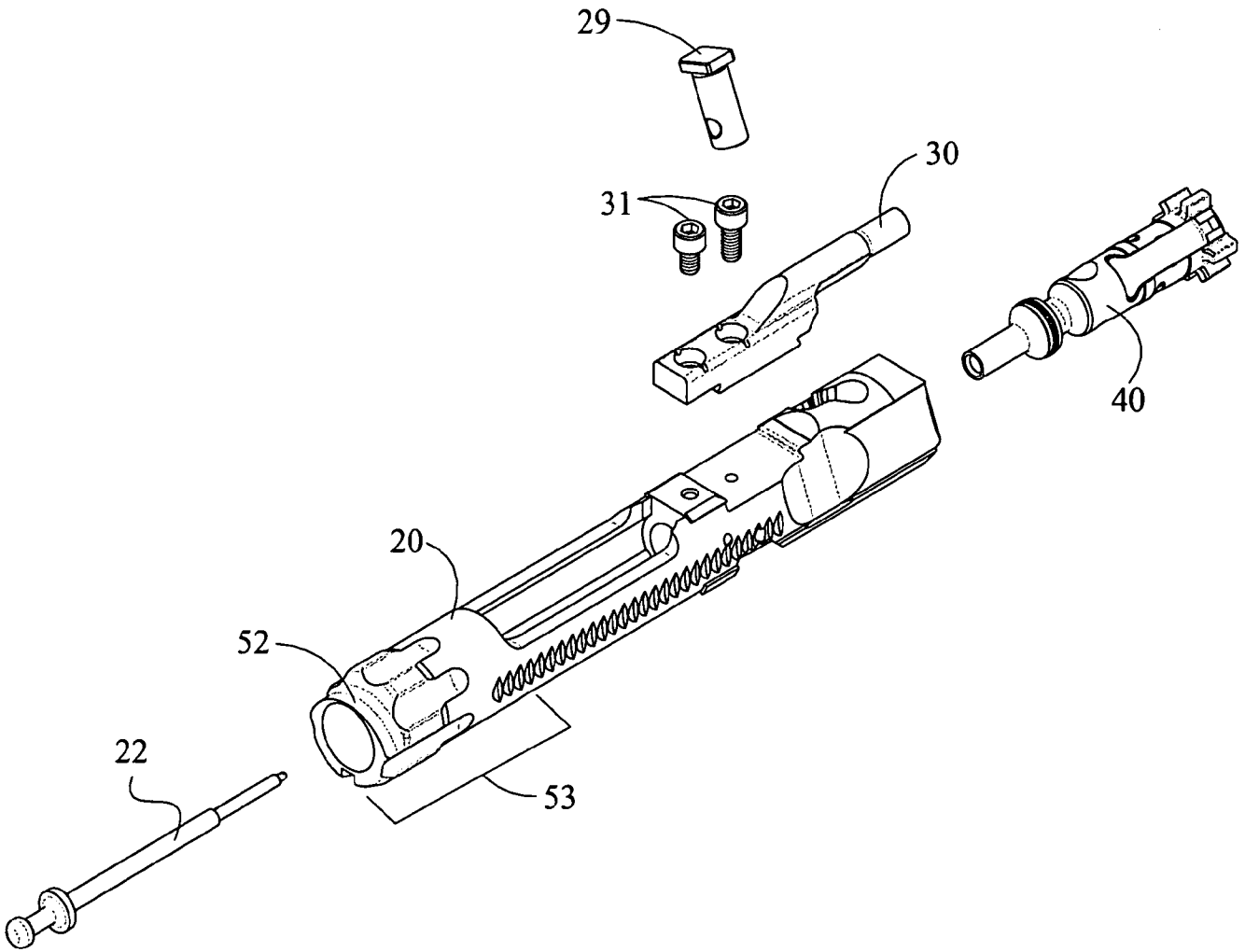
FIG. 2 is an exploded view thereof.
Figure 3:
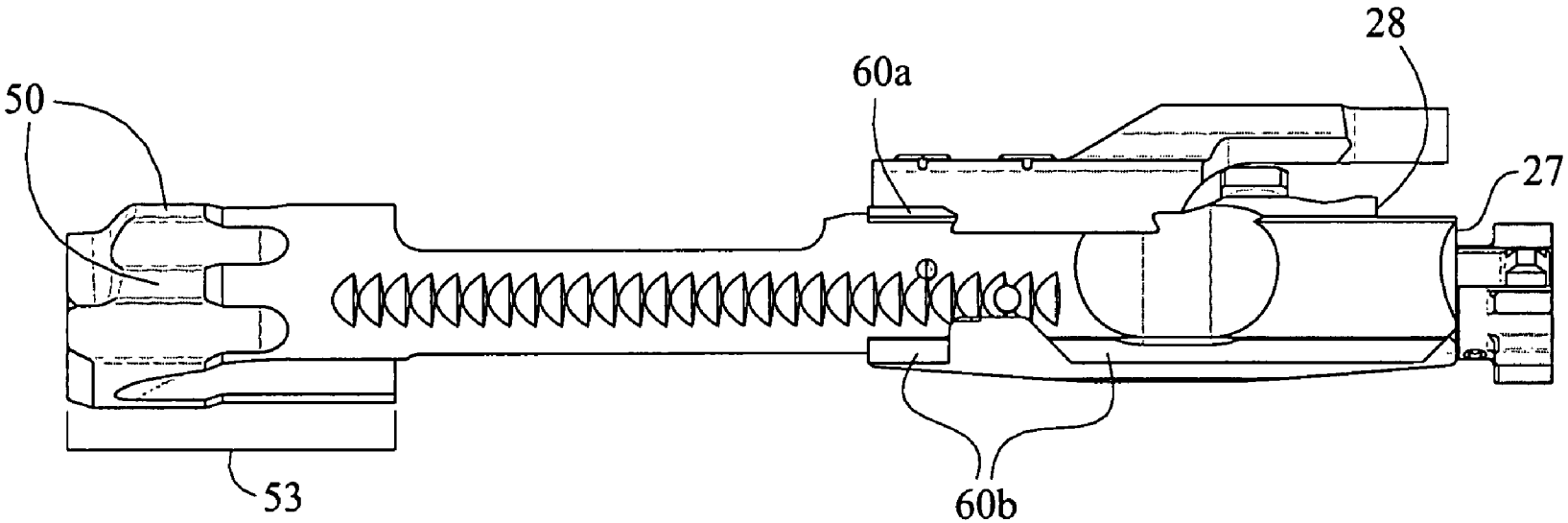
FIG. 3 is a side view thereof.
Figure 4:
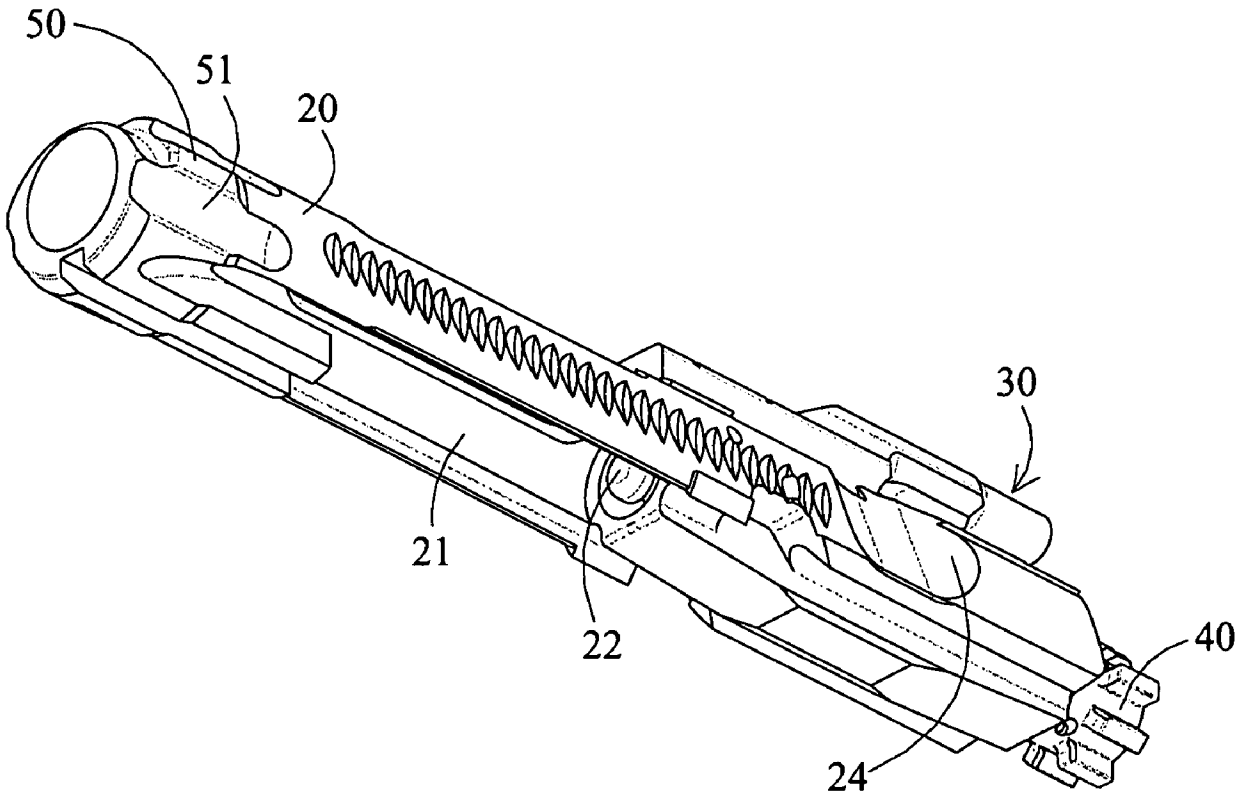
FIG. 4 is a bottom perspective view thereof.

Turning now to the drawings in which like reference characters indicate corresponding elements throughout the several views, as used herein, the word "front" or "forward" corresponds to the end of the bolt carrier assembly where the gas key is located (i.e., to the right as shown in FIGS. 1, 2, 3); "rear" or "rearward" or "back" corresponds to the direction opposite the end of the bolt carrier assembly where the gas key is located (i.e., to the left as shown in FIGS. 1, 2, 3).

Attention is first directed to FIG. 1 which illustrates the automatic rifle bolt carrier with fluted boss herein after referred to as the bolt carrier assembly generally designated 10 and FIG. 2 which is an exploded view of the bolt carrier assembly 10 of FIG. 1. It will be understood that bolt carrier assembly 10 is intended to be employed with any of the various M16 type firearms; however with minor modifications it could be more widely used for other firearms as well. M16 type firearms include the AR15 family of rifles, the M4 carbine family of rifles, the SR25, AR10 larger caliber type M16 rifles and other rifles that use the AR15 bolt carrier assembly. It will also be understood that bolt carrier assembly 10 is housed within an upper receiver of a firearm, not shown but well known in the prior art.

As shown in FIGS. 1, 2, 3, and 4 and referring particularly to FIG. 1, the preferred embodiment of the bolt carrier assembly 10 is shown. The bolt carrier 20 includes a hammer clearance slot 21 which permits the hammer (not shown but well known in the art) to extend into the bolt carrier 20 and strike a firing pin 22. Gas key 30 is retained by two alien head screws 31 which are threadedly secured into the bolt carrier 20 and a gas key dove tail 32 which interfaces with a dove tail 23 present on the bolt carrier 20. A door opener 24 provides room for the door latch (well known in the prior art) to close, and a cam slot 25 provides a contained area for the cam pin 29 to rotate thus allowing the bolt 40 to move rearwardly and rotate axially in the bolt carrier 20; the cam pin 29 retains the bolt 40 within the bolt carrier 20.

The rear external surface of the rearward end 53 of the bolt carrier 20 is provided with a boss 50 or area of increased diameter. The outer diameter of the boss is large enough to make contact with the inside of the upper receiver 71, thereby providing a series of bearing surfaces for the bolt carrier 20 during normal operation of the firearm. The boss 50 is generally located between the hammer clearance slot 21 and the rearward end of the bolt carrier 20; specifically the structure described as the boss 50 is limited to the areas on the external surface of the rearward end 53 of the bolt carrier 20 which are of sufficient diameter to make contact with the inside of the host firearm's upper receiver.

A series of longitudinal flutes 51, each of which extend from the backmost part of the rearward end 53 of the bolt carrier 20 and through the boss 50, are provided. The flutes have a concave surface that is recessed into the bolt carrier's 20 external surface. The flutes are evenly spaced about the boss 50 and rearward end 53 to allow an equipped firearm to be immediately fired upon exit from an aquatic environment. By cutting these flutes 51 through the boss 50 and into the external surface of the rearward end 53, water is able to drain from the internal operating area of the receiver and buffer tube thereby eliminating a pressure spike from occurring due to the presence of water inside of the host firearm's upper receiver when the firearm is discharged. The shape of the flutes shown is merely a preferred embodiment, other geometric shapes could be used to achieve the same or similar function.

A scallop cut 52, shown in FIG. 1, at the extreme rear end of the bolt carrier 20 is provided to allow an M16 (or related weapon) using the apparatus described in U.S. Pat. No. 7,806,039 ("the '039 patent") to be assembled without the use of tools. The scallop cut 52 is located about the rearmost end of the bolt carrier 20 and is perpendicular to the longitudinal axis of the bolt carrier 20. One side of the bolt carrier 20 is provided with forward assist notches 26 well known in the prior art.

Figure 5:
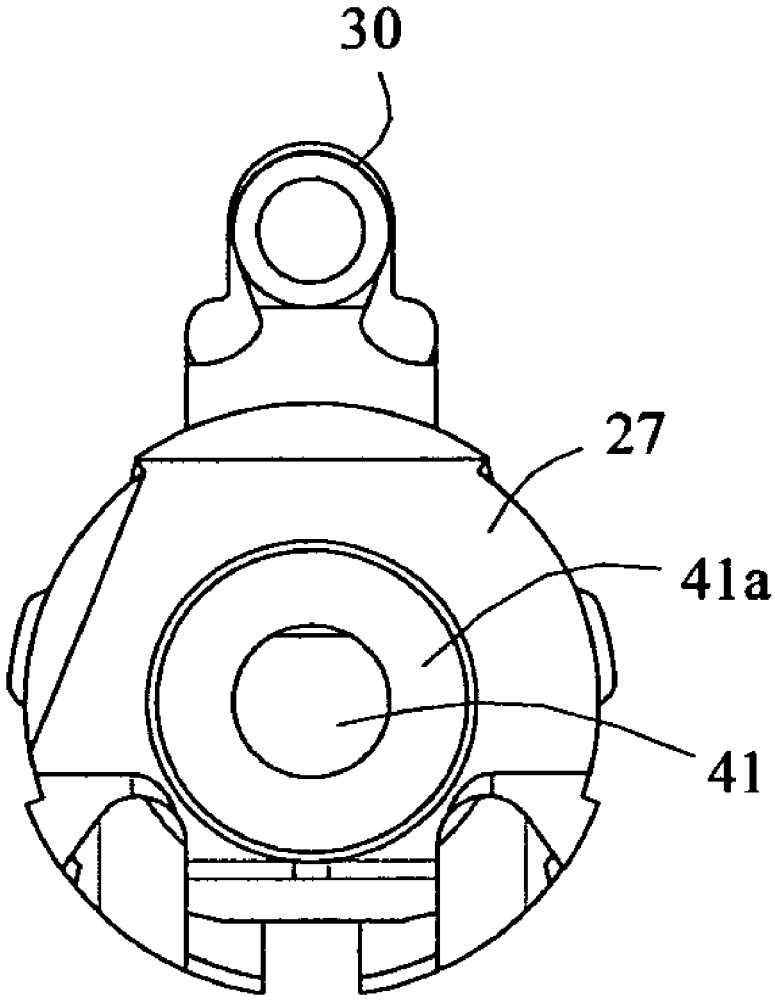
FIG. 5 is an end view of the automatic rifle bolt carrier with fluted boss.

As shown best in FIG. 5, a longitudinal bore 41*a* extends from the forward end 27 of the bolt carrier 20 rearwardly for a distance to accommodate the forward portion of the bolt 40. A smaller bore 41, continues for a further distance to accommodate the tail of the bolt 40. Additionally, and as best shown in FIGS. 3 and 5, there is a charging handle contact point 28.

Figure 6:
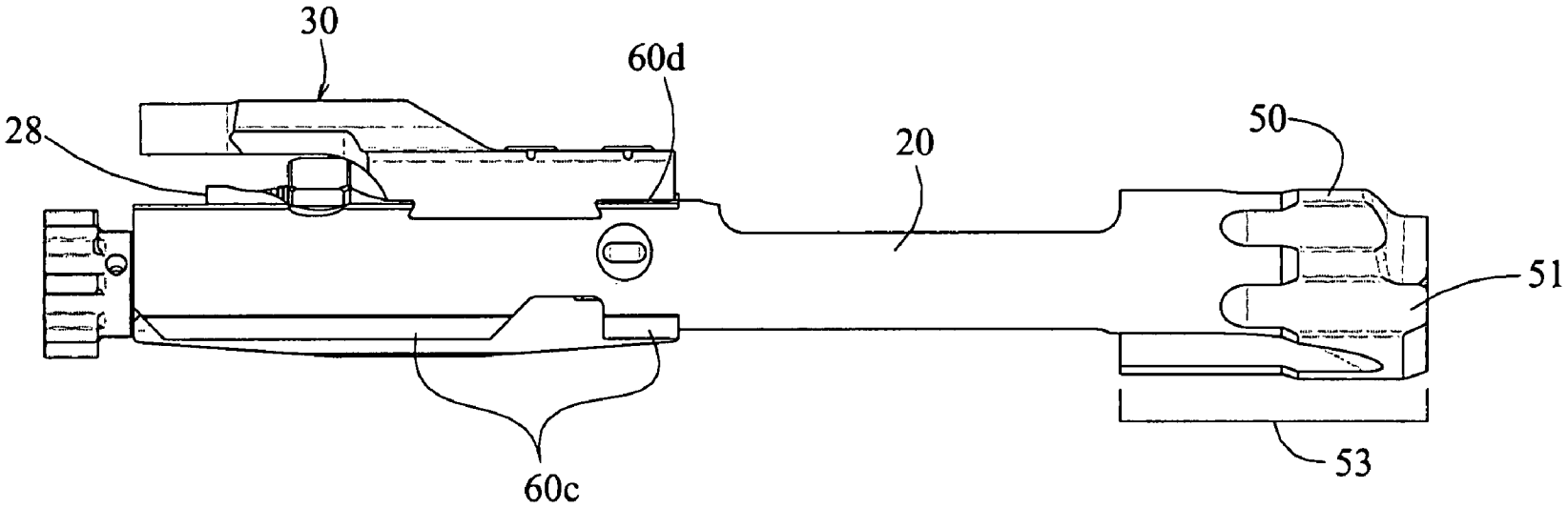
FIG. 6 is a side view of the bolt carrier of FIG. 3 wherein the bolt carrier is rotated about 180 degrees from the FIG. 3 view.

As shown in FIGS. 3 & 6, the bolt carrier 20 is provided with a series of four (4) lands which extend from the forward end 27 of the bolt carrier 20 rearwardly for a distance of about one-half the length of the bolt carrier. In FIG. 3, two (2) of the lands are shown at 60*a* and 60*b*. The third land 60*c* and fourth land 60*d* are shown best in FIG. 6 The lands 60*a*, 60*b*, 60*c*, and 60*d* along with the boss 50 support the front and back respectively, of the bolt carrier assembly 10 thereby preventing it from tilting during the normal operation of an M16 or related firearm.

As will be understood from the foregoing description and drawings, the invention provides substantially more area of contact about the exterior surface of the rearward end portion of the bolt carrier 20. In a specific example of the invention, the support provided by the boss 50 is of particular significance with firearms which utilize an indirect gas system that incorporates a piston (not shown but well known in the prior art) which during the normal phase of operation causes the rear of the bolt carrier 20 to tilt down and strike the lower receiver of an M16 type firearm thus damaging the receiver and causing the M16 type firearm to malfunction as a result of this increased friction.

The herein described invention provides a bolt carrier dove tail 23 and gas key dove tail 32 which work in cooperation with the (2) allen head screws 31 providing a substantially stronger method of retention over the prior art bolt carrier which, in general, relies solely on two screws as a method of retention. This is of particular use for weapons which utilize an indirect gas operating system.

As can be seen in the figures, the scallop cut 52 is provided at the rear of the bolt carrier 20. This feature provides an M16 type firearm using the apparatus disclosed in the '039 patent with a method of assembly that does not require the use of tools.

Without the scallop cut 52, a war fighter or other user must utilize specialized tools to reassemble the firearm after maintenance. This scallop cut 52 provides sufficient clearance so that the bolt carrier 20 does not impede the assembly of the firearm.

Additionally, a series of longitudinal flutes 51 spaced about the exterior of the boss 50 allow for water flow and thereby provide—a means for the war fighter to safely discharge a firearm, equipped with this bolt carrier 20, upon exiting an aquatic environment and to effectively execute over the beach operations.

Figure 7:
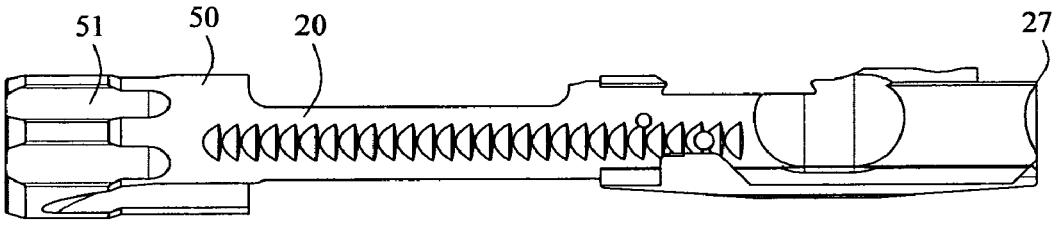
FIGS. 7-8 are side views of further embodiments of the bolt carrier of the invention.
Figure 8:
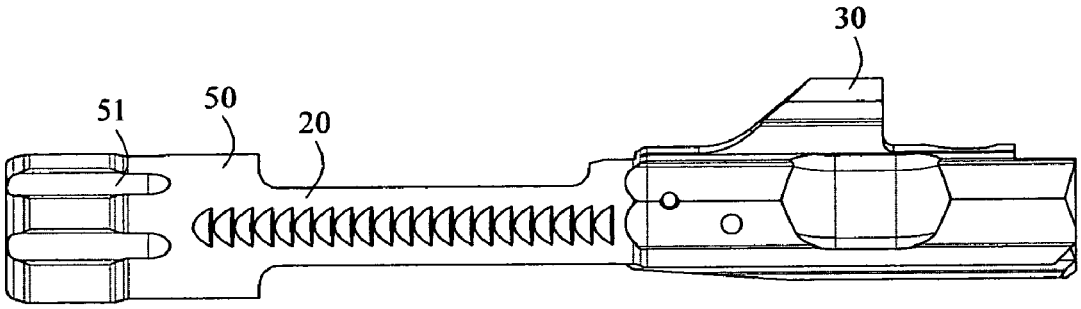

FIGS. 7-8 inclusive show additional embodiments of an automatic rifle bolt carrier with fluted boss 10 and in which the side views shown in such Figs. are the same as the side views of FIG. 3. As shown in FIG. 7, scallop cut 52 has been omitted leaving only the longitudinal flutes 51 on the boss 50. This saves machining time thereby cutting the cost of production if the bolt carrier 20 is not to be used with the device disclosed in the '039 patent. In FIG. 8, the bolt carrier 20 illustrated does not utilize a dove tail as a means of attachment, rather the unit is machined a single piece.

CONCLUSION, RAMIFICATIONS, AND SCOPE

Accordingly the reader will see that I have provided an automatic rifle bolt carrier with fluted boss which offers several advancements over the prior art bolt carrier. The herein disclosed device affords the user the ability to participate in over the beach operations and fire a weapon immediately upon exiting an aquatic environment. Decreased system maintenance and increased system reliability are achieved by strengthening the mounting point between the gas key and bolt carrier. Increasing the diameter of the boss located at the rear of the bolt carrier prevents the downward tilt of the carrier thus reducing premature wear of the lower receiver and minimizing malfunction associated with the increased friction of the prior art bolt carrier.

Another embodiment of the automatic rifle bolt carrier with fluted boss could eliminate the dove tail mating points for the gas key and the bolt carrier. Instead the bolt carrier and gas key could be machined as a single piece of material.

Still another embodiment of the automatic rifle bolt carrier with fluted boss could have the scallop cut located at the rear removed in order to reduce manufacturing cost if the host firearm is not intended to be equipped with the apparatus disclosed in U.S. Pat. No. 7,806,039 entitled "Firearm with Facility for Open-Bolt and Closed-Bolt Operation".

While the above drawings and description contain much specificity, these should not be construed as limitations on the scope of the invention, but rather as an exemplification of one preferred embodiment thereof.

Accordingly, the scope of the invention should be determined not by the embodiments illustrated, but by the appended claims and their legal equivalents.

What is claimed is:

1. A bolt carrier for an automatic rifle comprising an elongated cylinder having a forward end and a rearward end as said bolt carrier is positioned in said automatic rifle, said rearward end being provided with a boss having an outer diameter that is in contact with an interior of a receiver of said automatic rifle when said bolt carrier is assembled therewith, said rearward end having an external surface with a plurality of flutes evenly spaced apart thereon, said plurality of flutes being recessed into said external surface of said bolt carrier; and a scallop cut on the top rearmost end of said bolt carrier, said scallop cut being generally perpendicular to the longitudinal axis of said bolt carrier, and said scallop cut reducing the diameter of the rearmost end of said bolt carrier.

2. The bolt carrier as set forth in claim 1, wherein said flutes are substantially parallel to a longitudinal axis of said bolt carrier.

3. The bolt carrier as set forth in claim 2, wherein said flutes extend from a backmost part of said rearward end of said bolt carrier.

4. The bolt carrier as set forth in claim 1, wherein the rearmost end of said bolt carrier having the scallop cut has a diameter which is less than a depth of said flutes.

* * * * *